United States Patent [19]

Hansen

[11] 4,131,202

[45] Dec. 26, 1978

[54] CONSOLE GUN RACK

[76] Inventor: Lyle K. Hansen, 1110 13th St., Rawlins, Wyo. 82301

[21] Appl. No.: 652,798

[22] Filed: Jan. 27, 1976

[51] Int. Cl.[2] ..... A47F 7/00

[52] U.S. Cl. ..... 211/2; 211/64; 224/1 R

[58] Field of Search ..... 211/64, 2, 68, 6 R, 211/6 T, 6 SK; 312/235; 206/317, 216; 224/1 R, 42.45 B, 42.42 A, 42.46 B, 29 D

[56] References Cited

U.S. PATENT DOCUMENTS

| | | | |
|---|---|---|---|
| 2,678,682 | 5/1954 | Thomas | 312/235 R X |
| 2,775,351 | 12/1956 | Johnson et al. | 211/64 |
| 2,971,572 | 2/1961 | Watkins | 224/29 D |
| 3,477,586 | 11/1969 | Haluska | 211/64 |
| 3,497,077 | 2/1970 | Sjostrand | 211/64 |
| 3,767,094 | 10/1973 | Sikes | 224/1 R |

*Primary Examiner*—Roy D. Frazier
*Assistant Examiner*—Robert W. Gibson, Jr.
*Attorney, Agent, or Firm*—Daniel Jay Tick

[57] ABSTRACT

A console has a receiver for a gun barrel and a groove in the front of a cover to hold the stock of a rifle, when the console is open. The console has an access door in the cover to use the console to store articles when not carrying guns.

3 Claims, 5 Drawing Figures

CONSOLE GUN RACK

BACKGROUND OF THE INVENTION:

The present invention relates to a console gun rack. The console gun rack of the invention fits on the console panel between the front bucket seats of an automotive vehicle. When not in use holding guns, the console may be used to store articles.

BRIEF DESCRIPTION OF THE DRAWINGS:

In order that the invention may be readily carried into effect, it will now be described with reference to the accompanying drawings, wherein.

Figure 1:
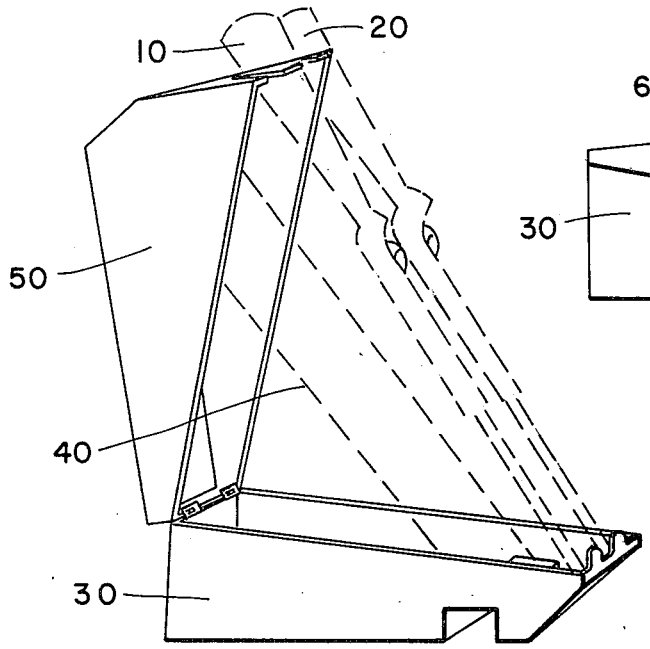
FIG. 1 is a perspective view of an embodiment of the console gun rack of the invention in open position.

DETAILED DESCRIPTION OF THE INVENTION:

In FIG. 1, rifles 10 and 20 rest, barrel down, in the console gun rack of the invention.

The console has a lower portion 30 with a front side having a pair of projections 80 (FIGS. 1 and 3 to 5) and an interior surface.

Figure 4:
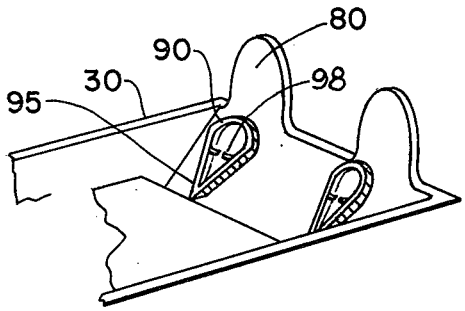
FIG. 4 is a perspective view, on an enlarged scale, of part of the lower portion of the embodiment of FIG. 1.
Figure 5:
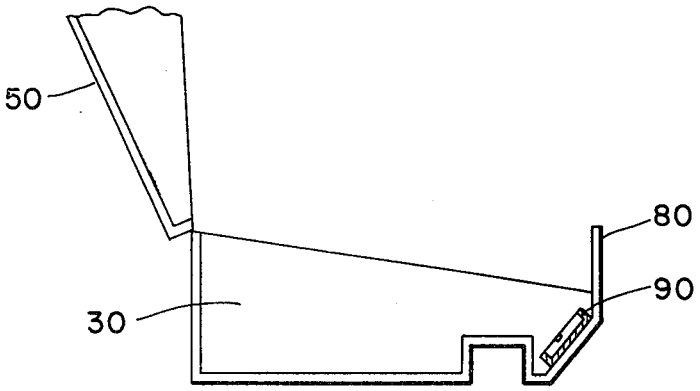
FIG. 5 is a sectional view of the embodiment of FIG. 1 in open position.

A pair of receivers 90 are mounted on the interior surface of the front side of the console lower portion 30, as shown in FIG. 4. Each of the receivers 90 has a tapering base 95 annd a bracket 98 (FIG. 4). A rifle barrel tip and front sight may be received in each of the receivers and the bracket 98 of the receiver permits the front sight to hang free.

A cover 50 is hingedly affixed to the lower portion 30 of the console and has a front side with a pair of grooves 70 formed therein (FIG. 3) for mating with the projections 80 of said lower portion. The stock of a rifle may be received in each of the grooves 70, as shown in FIG. 1.

Figure 2:
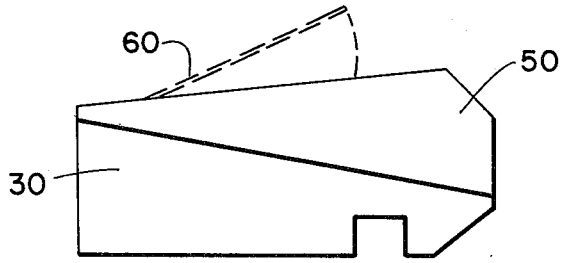
FIG. 2 is a side view of the embodiment of FIG. 1 in closed position.
Figure 3:
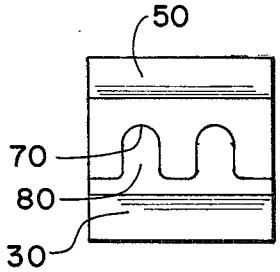
FIG. 3 is a front view of the embodiment of FIG. 1 in closed position.

An access door 60 (FIG. 2) is mounted in the cover 50. The access door 60 permits the console to be used to store articles when not holding a rifle or rifles. The access door 60 is convenient to the operator of the vehicle and a passenger therein.

A holding device such as, a chain 40, holds the cover 50 open relative to the lower portion 30 whereby a rifle or rifles may be held by the console when said console is open. The chain 40 extends between a lower edge of the cover 50 and an upper edge of the lower portion 30.

The console of the invention fits between the front bucket seats of a four wheel drive vehicle such as, for example, a "Blazer," "Jimmy," "Ramcharger," and the like. Furthermore, the console of the invention may be made to hold up to four guns, depending upon the year of the vehicle.

Since the console fits between the front seats, there is no need to bolt or hook said console to said seats. When the console is positioned between the front seats, said console is securely fastened to the floor of the vehicle and need not be removed from the vehicle when not in use, as would be a gun rack of standard construction.

The lower portion 30 of the console may be used to carry ammunition, hunting licenses, hunting knives, binoculars, or the like, and other articles.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A console gun rack, comprising a console having a lower portion with a front side, the front side of the lower portion of the console having a projection and an interior surface;

a receiver having a tapering base mounted on interior surface of the front side of the console whereby a rifle barrel tip and front sight may be received therein, said receiver having an integral bracket whereby said front sight may hang free;

a cover hingedly affixed to the lower portion of the console, said cover having a front side with groove in said front side for mating with the projection of said lower portion whereby the stock of a rifle may be received in said groove;

an access door mounted in said cover whereby said console may be used to store articles when not holding a rifle; and holding means for holding said cover open relative to said lower portion whereby a rifle may be held by said console when said console is open.

2. A console gun rack as claimed in claim 1, wherein said console is affixable to a console panel between a pair of front seats of a vehicle.

3. A console gun rack as claimed in claim 1, wherein said lower portion has an upper edge and said cover has a lower edge and said holding means comprises a chain extending between the lower edge of said cover and the upper edge of said lower portion.

* * * * *